US006748163B2

(12) United States Patent
Wilson

(10) Patent No.: US 6,748,163 B2
(45) Date of Patent: Jun. 8, 2004

(54) ELECTRIC HEATER WITH DUAL OVERHEAT LIMITS

(75) Inventor: Bradley J. Wilson, Seattle, WA (US)

(73) Assignee: King Electrical Manufacturing Company, Seattle, WA (US)

( * ) Notice: Subject to any disclaimer, the term of this patent is extended or adjusted under 35 U.S.C. 154(b) by 0 days.

(21) Appl. No.: 10/198,981

(22) Filed: Jul. 18, 2002

(65) Prior Publication Data

US 2003/0016953 A1 Jan. 23, 2003

Related U.S. Application Data

(60) Provisional application No. 60/306,909, filed on Jul. 19, 2001.

(51) Int. Cl.[7] ..... F24H 3/00
(52) U.S. Cl. ..... 392/360
(58) Field of Search ..... 392/360–369, 392/356, 358, 379–385

(56) References Cited

U.S. PATENT DOCUMENTS

| | | | | | |
|---|---|---|---|---|---|
| 2,594,101 | A | * | 4/1952 | Volker | 392/365 |
| 2,866,073 | A | * | 12/1958 | Omohundro | 392/365 |
| 3,267,255 | A | * | 8/1966 | Schulz | 392/360 |
| 3,525,851 | A | * | 8/1970 | Seabury, Jr. | 392/360 |
| 4,309,594 | A | * | 1/1982 | Jones | 392/365 |
| 4,642,441 | A | * | 2/1987 | Kenyon | 392/365 |
| 4,755,653 | A | | 7/1988 | Townsend et al. | |
| 4,812,622 | A | * | 3/1989 | Takeda et al. | 392/38 |
| 4,912,300 | A | * | 3/1990 | Hennuy et al. | 392/365 |
| 5,007,103 | A | | 4/1991 | Tyrrell et al. | |
| 5,083,011 | A | | 1/1992 | Munroe | |
| 5,245,691 | A | | 9/1993 | Wu | |
| 5,568,586 | A | * | 10/1996 | Junkel | 392/376 |
| 5,805,767 | A | | 9/1998 | Jouas et al. | |
| 6,430,364 | B2 | * | 8/2002 | Kishita | 392/360 |

FOREIGN PATENT DOCUMENTS

| | | | | |
|---|---|---|---|---|
| CA | 716678 | * | 8/1965 | 392/368 |
| EP | 105814 | * | 4/1984 | |

* cited by examiner

*Primary Examiner*—John A. Jeffery
(74) *Attorney, Agent, or Firm*—Garrison & Associates PS; David L. Garrison

(57) ABSTRACT

An electric heater comprises a housing with an air inlet area, an air outlet area, an electric heating element disposed between the inlet area and outlet area, a fan that moves air through the heater, a first high-temperature limit switch mounted on the housing in the air inlet area, and a second high-temperature limit switch mounted on housing in the air outlet area, the first and second switches being electrically connected in series with each other and to the heating element so as to disconnect power to the heating element when either switch is tripped.

14 Claims, 4 Drawing Sheets

ELECTRIC HEATER WITH DUAL OVERHEAT LIMITS

CROSS-REFERENCE TO RELATED APPLICATIONS

This application claims the benefit of U.S. Provisional Application Serial No. 60/306,909, entitled ELECTRIC HEATER WITH DUAL OVERHEAT LIMITS, filed Jul. 19, 2001.

FIELD OF THE INVENTION

The present invention relates, generally, to electric heating devices. More particularly, the invention relates to overheat protection for an electric space heater. The invention has particular utility in wall-mounted electric room heaters.

BACKGROUND OF THE INVENTION

The basic operation of all electric room heaters is the same. A fan takes in room air in an inlet area and moves it across electrical heating elements, which warm the air. The heated air is then discharged from a discharge area back into the room. Typically there is no variable power condition for the heating elements; they are either off or on. When the heating elements are on, a minimum amount of heat must be transferred from the heating elements to the air flowing across them to keep the temperature of the heating elements below a desired level. If there is too little heat transfer, the heating elements can overheat and potentially burn out or cause a fire.

Heat transfer from the heating elements to the air flowing over them depends on the initial temperature of the air flowing across the heating elements and the amount of the airflow. If the airflow amount is reduced, the air will be in contact with the heating elements longer than desired, the outlet temperature will be the significantly higher than desired, and the temperature of the heating elements will also be significantly higher than desired. Likewise, if the initial inlet air temperature is significantly higher than it should be, even with the proper airflow amount, the outlet temperature and the temperature of the heating elements can be significantly higher than desired.

The state of the art includes various devices and methods for detecting an abnormal heating condition, particularly overheating, in an electric heater used to heat room air. Many heaters have a temperature limit switch located near the heating element or output area to detect an over-temperature condition.

U.S. Pat. Nos. 4,755,653 and 5,007,103 disclose heaters with circuits that interrupt power to the heating elements when a sensor detects an internal temperature greater than a predetermined maximum. However, those patents do not disclose a particular location for sensing the internal temperature.

In U.S. Pat. No. 5,083,011 to Munroe, two heater control signals are produced. One signal is a minimum pressure differential between static air pressure outside a hollow housing and the air velocity pressure within the housing. The other signal is a temperature of a portion of the housing lower than a predetermined maximum. The heater is actuated only when both of those signals are present.

U.S. Pat. No. 5,245,691 to Wu discloses an electric circuit for a heater which interrupts power to the heater when either an internal temperature exceeds a limit or the heater is tilted.

A heater incorporating more safety devices is disclosed in U.S. Pat. No. 5,805,767 to Jouas. The heater element is deenergized if any of the following occur: the internal temperature of the heater exceeds a set maximum, the rate at which the internal temperature is increasing exceeds a given rate, the internal temperature exceeds the ambient air temperature by a given amount, or when motion is detected near the front of the heater. The features disclosed in Jounas are more proactive than the purely reactive features of the other patents in that they can shut off the heating element before it has become too hot, but the features are relatively complex and expensive.

The present invention provides an improved electrical heater which overcomes the limitations and shortcomings of the prior art.

DETAILED DESCRIPTION OF THE INVENTION

Figure 1:
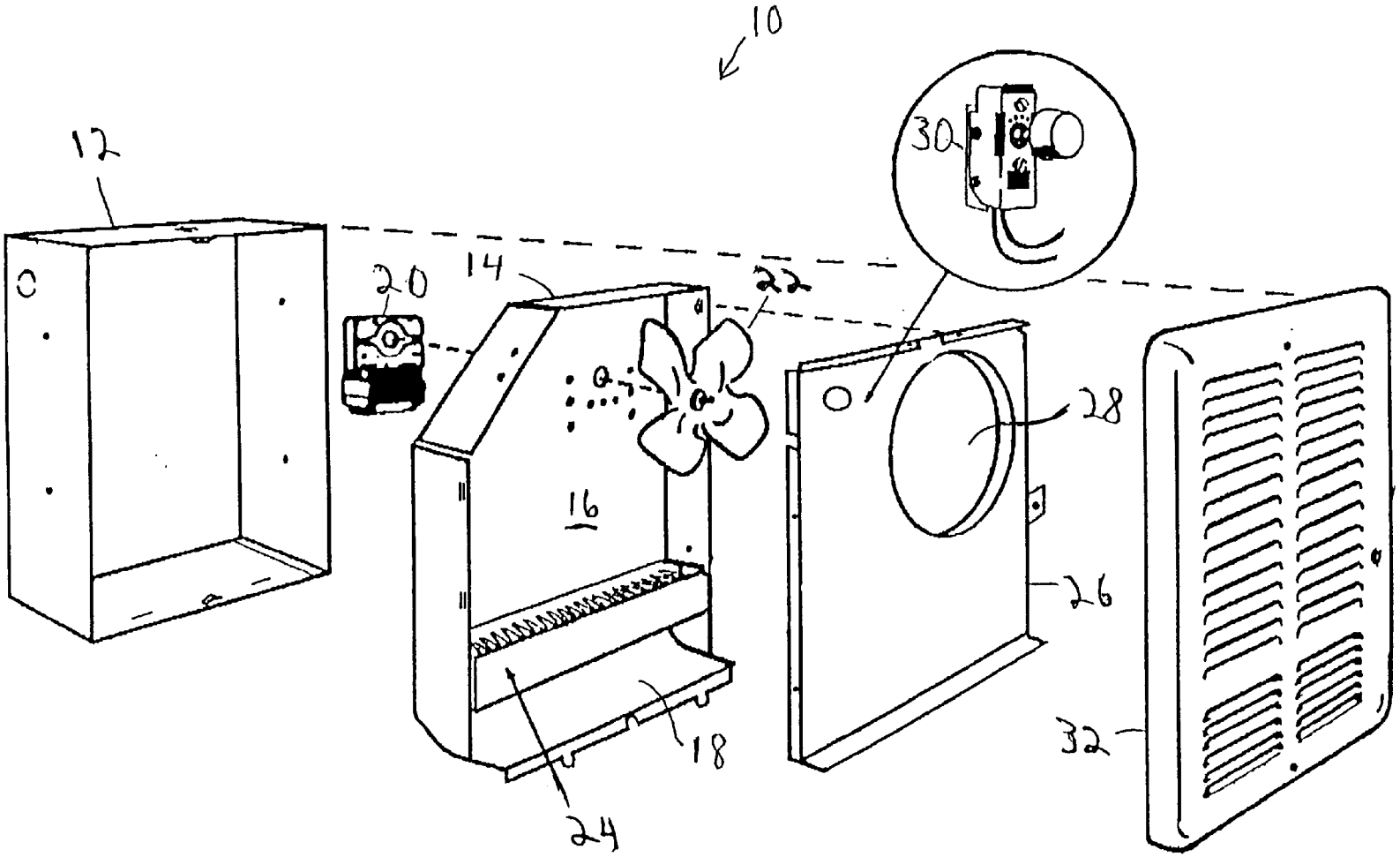
FIG. 1 (PRIOR ART)
FIG. 1 is an exploded perspective view of an electric wall heater that uses the present invention.

Referring to FIG. 1, a typical wall-mounted electric room heater is generally indicated by the reference numeral 10. Heater 10 includes a wall can 12 that receives housing 14 which has an inlet area 16 and an outlet area 18 that is curved to direct air outward from housing 14. A fan motor 20 is mounted on the back of housing 14 and drives fan 22 to move air across heating element 24 located in housing 14 between inlet area 16 and outlet area 18. Housing cover 26 closes housing 14 and has an aperture 28 which receives fan 22 and provides an air inlet. Housing 14 and housing cover 26 are preferably made of sheet metal. A thermostat 30 is mounted on housing cover 26. Grill 32 attaches to wall can 12 and covers the assembled housing 14 and housing cover 26.

The present invention installs two different temperature limit switches on the housing 14, one for the inlet area 16 and another for the outlet area 18. With housing 14 made of sheet metal, these limit switches are mounted on the back of housing 14 and detect the temperature of the sheet metal at those locations.

Figure 2:
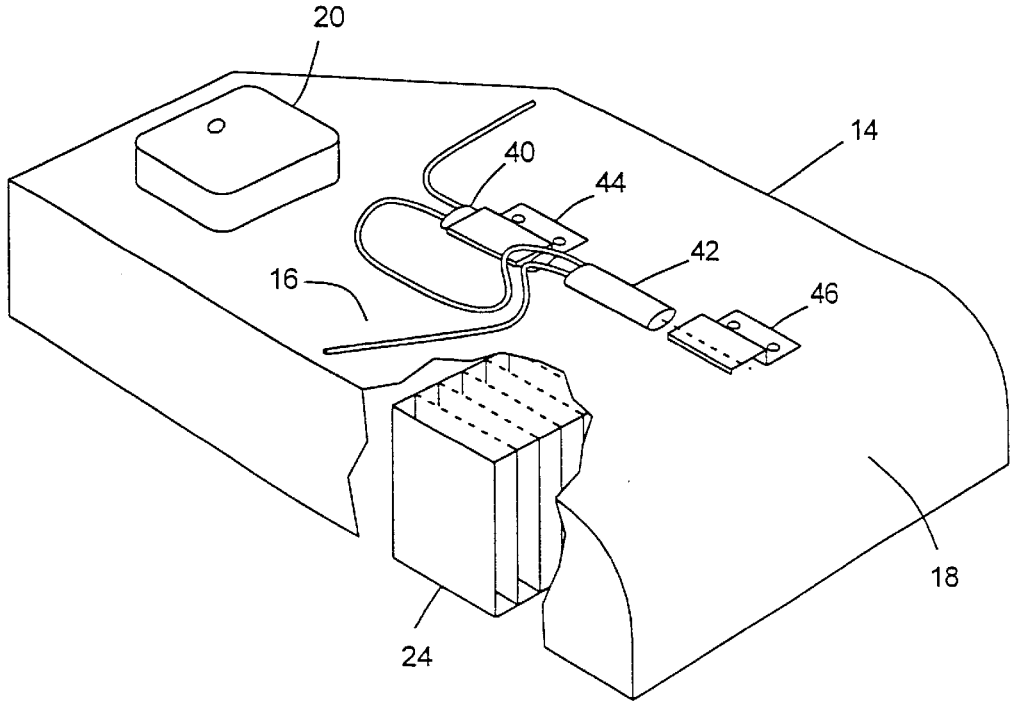
FIG. 2 is a perspective view of the back side of the housing of the heater of FIG. 1 with the limit switches of the present invention installed. Wiring for the other electrical components of the heater has been omitted for clarity. A portion of the housing is shown cut away to show the location of the heating element.

Referring to FIG. 2, temperature limit switches 40 and 42 detect the temperature of the inlet area 16 and outlet area 18 respectively of housing 14. Switches 40 and 42 are preferably held in place by Z-shaped clips 44 and 46 respectively attached to the back of housing 14 at the desired locations by fastening means such as mechanical fasteners or welding. Switches 40 and 42 are generally flat elongated metal devices sheathed in a protective film. Such switches are readily available from Thermtrol Corp. of North Canton, Ohio. The preferred switches have a self-holding feature such that when the switch is opened due to a temperature rise, it will remain open until power is removed either by turning down the thermostat 30 or disconnecting the power supply. For switch 40, sensing the temperature of the inlet area, the preferred temperature trip range is between 130 and 170 degrees Fahrenheit. A switch suitable for that application is Thermtrol part number SH7AM022A5 which trips at approximately 75° C., (167° F.) or SH7AM020A5 which trips at approximately 65° C., (148° F.). For switch 42, sensing the temperature of the outlet area, the preferred temperature trip range is between 190 and 225 degrees Fahrenheit. A Switch suitable for that application is Thermtrol part number SH7AM026A5 which trips at 95° C., (203° F.). The switches 40 and 42 easily slide into and fit snugly in clips 44 and 46 respectively and contact the back side of housing 14 to detect the temperature thereof. By sensing the sheet metal temperatures, the switches are not susceptible to transient conditions, such as the temporary disturbance of the airflow if someone walks close to the heater outlet. Also, since the switches are mounted on the back of housing 14, they are not in the airflow stream and are, therefore, less susceptible to contaminants such as dust, lint and the like which can reduce reliability.

Figure 3:
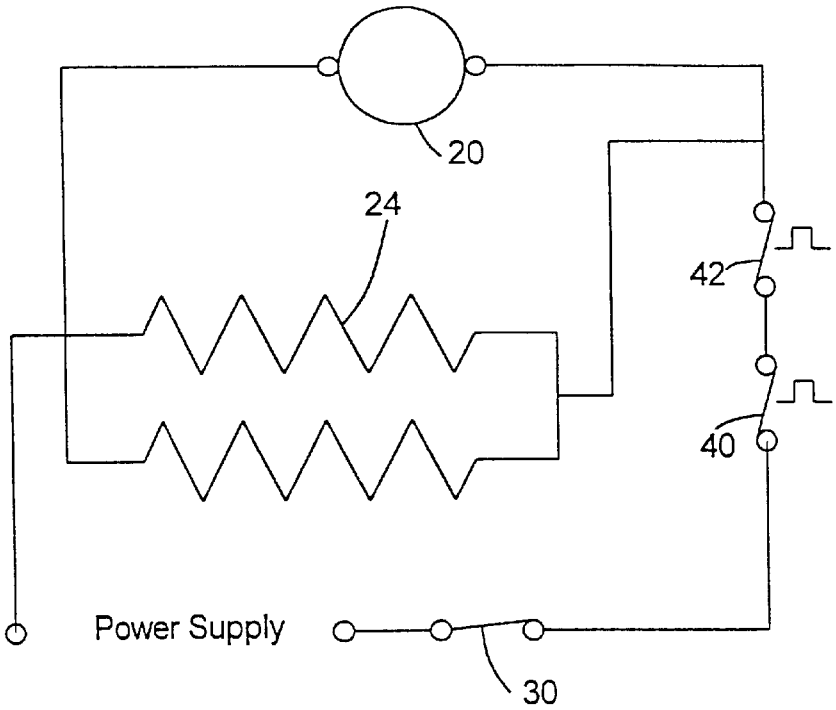
FIG. 3 is a preferred schematic wiring diagram for the electrical elements of the heater of FIG. 2.
Figure 4:
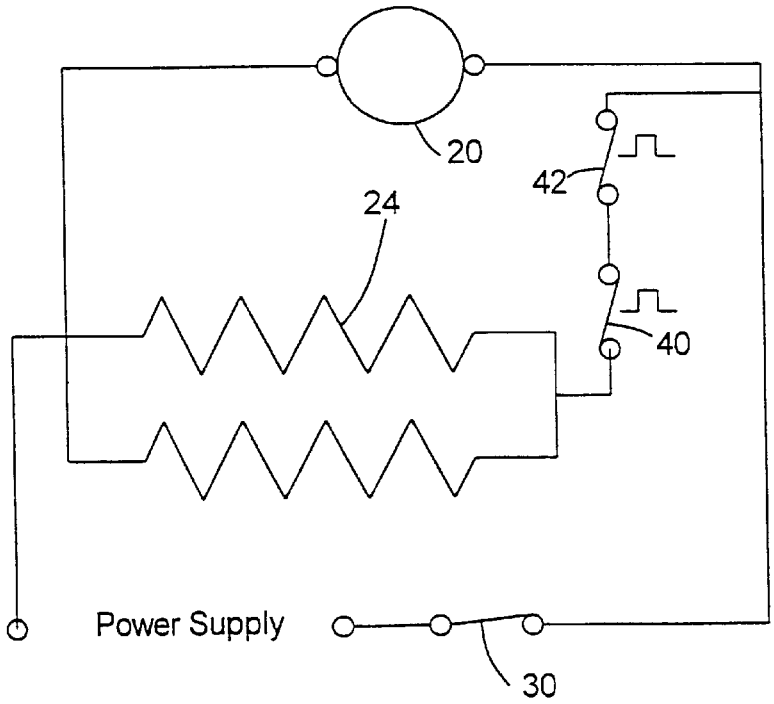
FIG. 4 is an alternate schematic wiring diagram for the electrical elements of the heater of FIG. 2.
Figure 5:
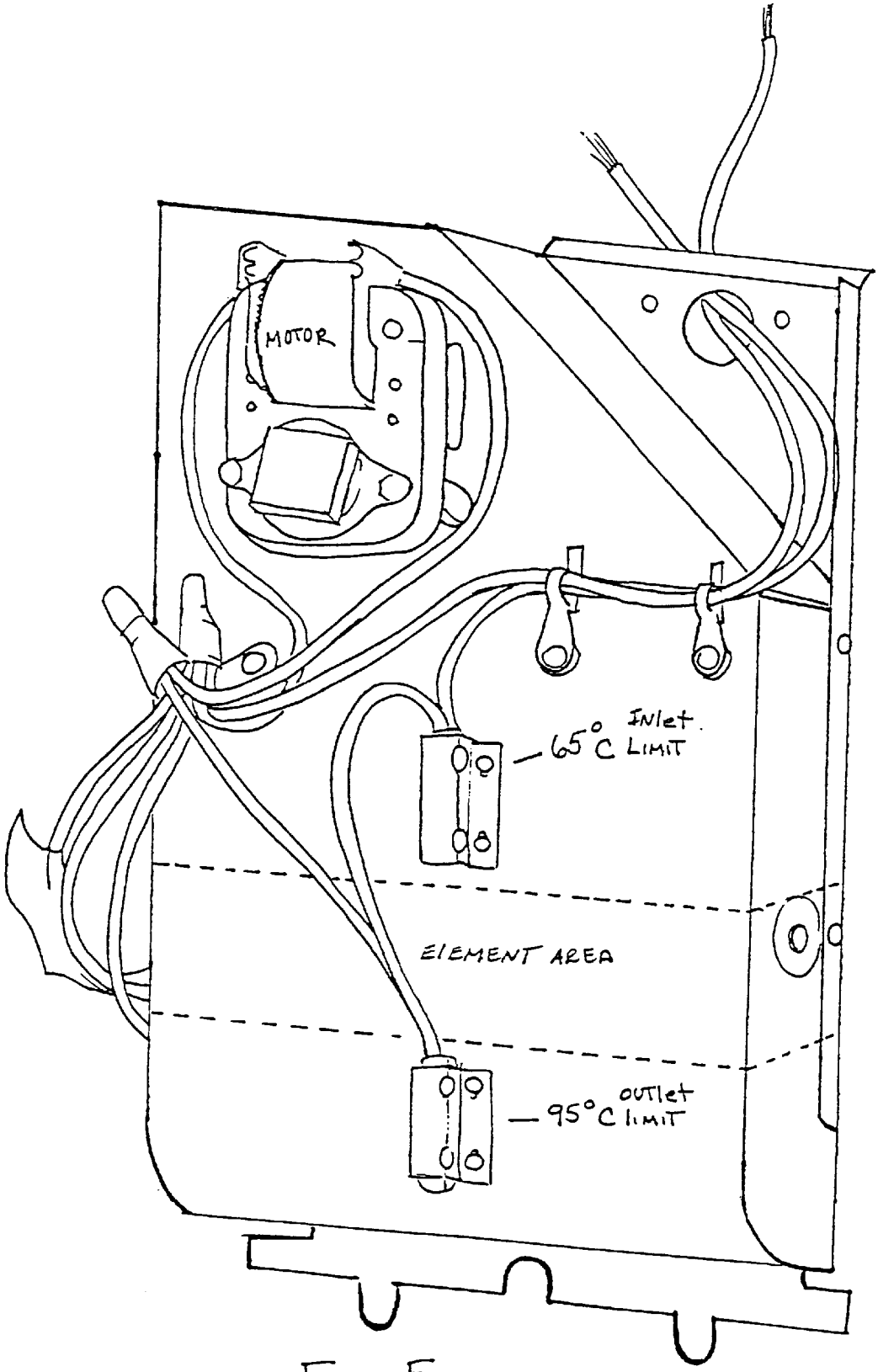
FIG. 5 is a figure similar to FIG. 2 showing the wiring and sensors in more detail.

Referring also to FIG. 3, switches 40 and 42 are wired in series with each other and so that power to the heating element, and preferably also to the fan, is disconnected if either of limit switches trip. Alternatively, as shown in FIG. 4, the limit switches 40 and 42 can be wired such that only the heating element is disconnected if either switch trips and the fan continues to run to circulate air and cool the overheated portions.

In operation, if the air outlet area 18 is completely blocked, the outlet area temperature will increase and limit switch 42 will trip and disconnect power to the heating element. If an item, such as a sofa or cardboard box, is placed a few inches in front of the air outlet area 18, the heated air will be deflected by the object and much of the heated air will be pulled into the air inlet area 16 by fan 22, thereby rapidly increasing the temperature of the inlet area and tripping limit switch 40. The addition of the temperature limit switch to sense the temperature of the inlet area of the heater detects the abnormal operation condition of the heater where the outlet is partially blocked to deflect a portion of the heated air back into the inlet area of the heater and thereby provides additional safety over heaters that only detect the outlet temperature.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. An electric heater having a housing made of metal with a back plate, an air inlet area, an air outlet area, an electric heating element disposed between the inlet area and outlet area, and a fan that draws air into the inlet area, moves it across the heating element, and discharges it from the outlet area, an improved overheating system, comprising:

a first high-temperature limit switch mounted on the back plate of the housing in the air inlet area outside the air stream passing through said heater, whereby the first high-temperature switch detects the temperature of the metal at that location, the switch being electrically connected to the heating element so as to disconnect power to the heating element when the switch is tripped.

2. The improvement of claim 1, further comprising a second high-temperature limit switch mounted on the back plate of the housing in the air outlet area outside the air stream passing through said heater, whereby the second high-temperature switch detects the temperature of the metal at that location, the first and second switches being electrically connected in series with each other and to the heating element so as to disconnect power to the heating element when either switch is tripped.

3. An electric heater, comprising:

a metal housing with a back plate an air inlet area, and an air outlet area;

an electric heating element disposed between the inlet area and outlet area;

a fan that draws air into the inlet area, moves it across the heating element, and discharges it from the outlet area; and a first high-temperature limit switch mounted on the backplate of the housing in the air inlet area outside the air stream passing through said heater, whereby the first high-temperature switch detects the temperature of the metal at that location, the switch being electrically connected to the heating element so as to disconnect power to the heating element when the switch is tripped.

4. The heater of claim 3, further comprising a second high-temperature limit switch mounted on the back plate of the housing in the air outlet area outside the air stream passing through said heater, whereby the second high-temperature switch detects the temperature of the metal at that location, the first and second switches being electrically connected in series with each other and to the heating element so as to disconnect power to the heating element when either switch is tripped.

5. The heater of claim 4, wherein the housing has a back, and wherein both the first and second limit switches are mounted on the back outside the air stream passing through said heater.

6. The heater of claim 4, wherein the housing is made of metal.

7. The heater of claim 3, wherein housing has a back, and wherein the first limit switch is mounted on the back outside the air stream passing through said heater.

8. The heater of claim 3, wherein the housing is made of metal.

9. An electric heater, comprising:

a metal housing with a back plate, an air inlet area, and an air outlet area;

an electric heating element disposed between the inlet area and outlet area;

a fan that draws air into the inlet area, moves it across the heating element, and discharges it from the outlet area;

a first high-temperature limit switch mounted on the back plate of the housing in the air inlet area outside the air stream passing through said heater, whereby the first high-temperature switch detects the temperature of the metal at that location; and a second high-temperature limit switch mounted on the back plate of the housing in the air outlet area outside the air stream passing through said heater, whereby the second high-temperature switch detects the temperature of the metal at that location, the first and second switches being electrically connected in series with each other and to the heating element so as to disconnect power to the heating element when either switch is tripped.

10. The heater of claim 9, wherein the first and second limit switches are electrically connected to the fan and the heating element such that power is disconnected from both the fan and the heating element when either switch is tripped.

11. An electric heater, comprising:

a metal housing with a back plate, an air inlet area, and an air outlet area;

an electric heating element disposed between the inlet area and outlet area;

a fan that draws air into the inlet area, moves it across the heating element, and discharges it from the outlet area;

a first high-temperature limit switch mounted on the back plate of the housing in the air inlet area outside the air stream passing through said heater, whereby the first high-temperature switch detects the temperature of the metal at that location; and a second high-temperature limit switch mounted on the back plate of the housing in the air outlet area outside the air stream passing through said heater, whereby the second high-temperature switch detects the temperature of the metal at that location, the first and second switches being electrically connected in series with each other and to the heating element so as to disconnect power to the heating element when either switch is tripped.

12. The heater of claim 11, wherein the housing has a back, and wherein both the first and the second limit switches are mounted on the back of the housing.

13. An electric heater, comprising:

a metal housing with a back plate, an air inlet area, and an air outlet area;

an electric heating element disposed between the inlet area and outlet area;

a fan that draws air into the inlet area, moves it across the heating element, and discharges it from the outlet area;

a first high-temperature limit switch for sensing the temperature of the inlet area having a temperature trip range is between 130 and 170 degrees Fahrenheit, the first high-temperature switch mounted on the back plate of the housing in the air inlet area outside the air stream passing through said heater, whereby the first high-temperature switch detects the temperature of the metal at that location; and a second high-temperature limit switch for sensing the temperature of the outlet area having a temperature trip range is between 190 and 225 degrees Fahrenheit, the second high-temperature switch mounted on the back plate of the housing in the air outlet area outside the air stream passing through said heater, whereby the second high-temperature switch detects the temperature of the metal at that location, the first and second switches being electrically connected in series with each other and to the heating element so as to disconnect power to the heating element when either switch is tripped.

14. The first high-temperature and the second high-temperature switches of claim 13, having a self-holding feature such that when the switch is opened due to a temperature rise, it will remain open until power is removed either by turning down the thermostat or disconnecting the power supply.

* * * * *